US007568587B2

(12) United States Patent
Cook et al.

(10) Patent No.: US 7,568,587 B2
(45) Date of Patent: Aug. 4, 2009

(54) PRESSURE INDICATING FEATURE FOR REPLACEABLE CONTAINER CAPS

(75) Inventors: Steven T. Cook, Dayton, OH (US); Mark F. Broerman, Dayton, OH (US); Dale R. Conley, Dayton, OH (US)

(73) Assignee: Dayton Systems Group, Inc., Miamisburg, OH (US)

( * ) Notice: Subject to any disclaimer, the term of this patent is extended or adjusted under 35 U.S.C. 154(b) by 253 days.

(21) Appl. No.: 10/936,338

(22) Filed: Sep. 8, 2004

(65) Prior Publication Data

US 2005/0051554 A1 Mar. 10, 2005

Related U.S. Application Data

(60) Provisional application No. 60/501,374, filed on Sep. 9, 2003.

(51) Int. Cl.
*B65D 41/04* (2006.01)

(52) U.S. Cl. ..... 215/329

(58) Field of Classification Search ..... 215/337, 215/316, 336, 271, 270; 220/301, 298, 296, 220/293; 53/487, 485, 290; 29/592, 406
See application file for complete search history.

(56) References Cited

U.S. PATENT DOCUMENTS 1,495,722 A * 5/1924 Anderson ..... 215/307
1,592,819 A * 7/1926 Buschman ..... 215/337
2,194,004 A * 3/1940 Bukolt ..... 215/271
2,309,828 A * 2/1943 Dalby ..... 72/359
2,603,987 A * 7/1952 Lyon ..... 72/353.2
2,914,206 A * 11/1959 Lowen ..... 215/320
3,142,409 A * 7/1964 Ross ..... 220/281

(Continued)

FOREIGN PATENT DOCUMENTS

DE 2449134 A * 4/1976

(Continued)

OTHER PUBLICATIONS

Sibley, Michael. "Message in a Bottle's Shape: Technology Food Safety: Michael Sibley Reports on a New Method of Testing the Safety of Food and Drink Containers". Financial Times. London, Mar. 16, 2000, p. 13.*

(Continued)

*Primary Examiner*—Anthony D Stashick
*Assistant Examiner*—Robert J Hicks
(74) *Attorney, Agent, or Firm*—Fay Sharpe LLP

(57) ABSTRACT

An improved cap, and apparatus and a method for making such cap, including tooling for the first station are provided. The improved cap has a central button feature in its top panel that can move slightly upward or downward with respect to the remainder of the cap. When a container is filled, liquid Nitrogen is added just before the cap is applied. The liquid Nitrogen turns into gas and creates pressure in the container, causing the button to rise. When a consumer opens the cap, the gas is released and the button returns to its normal (down) position, or if pressure is accidentally lost the button returns to its normal (down) position. Thus indicating loss of pressurization and possible resulting spoilage, or will indicate that the container has been open, and may contain only partial product.

6 Claims, 3 Drawing Sheets

U.S. PATENT DOCUMENTS 3,160,302 A * 12/1964 Chaplin ..... 215/271
3,160,303 A * 12/1964 Healy ..... 215/344
3,281,000 A * 10/1966 Lowen ..... 215/344
3,414,151 A * 12/1968 Morrison ..... 215/344
3,967,746 A * 7/1976 Botkin ..... 215/260
4,209,102 A * 6/1980 Dunn et al. ..... 215/329
4,533,059 A * 8/1985 Kapolas et al. ..... 215/230
4,770,309 A * 9/1988 Thompson ..... 215/344
5,581,978 A * 12/1996 Hekal et al. ..... 53/411
6,015,062 A * 1/2000 Bachmann et al. ..... 220/295
6,082,166 A * 7/2000 Marin ..... 72/348
6,082,944 A * 7/2000 Bachmann et al. ..... 413/22
2005/0138984 A1* 6/2005 Cook et al. ..... 72/361

FOREIGN PATENT DOCUMENTS

WO WO 0249787 A1 * 6/2002
WO WO 02068278 A2 * 9/2002
WO WO 2005021388 A2 * 3/2005

OTHER PUBLICATIONS

"Inspector Measures Lid Shape". Chilton's Food Engineering. Radnor, Jul./Aug. 1997. vol. 69, Issue 7/8, p. 46.*

* cited by examiner

PRESSURE INDICATING FEATURE FOR REPLACEABLE CONTAINER CAPS

RELATED APPLICATION

This application is related to U.S. Provisional patent application Ser. No. 60/501,374 filed 9 Sep. 2003, entitled PRESSURE INDICATING FEATURE FOR REPLACEABLE CONTAINER CAPS, the entire disclosure of which is incorporated herein by reference.

BACKGROUND OF THE INVENTION

U.S. Pat. No. 6,015,062, assigned to the assignee of this application, Dayton Systems Group, Inc., discloses closure construction for reclosable containers (e.g, a can body) wherein a domed container end with a neck portion having a pour opening is provided with a reclosable lugged type of cap. The inventions disclosed in that U.S. Patent and in related Published International Application No. PCT/US01/06046 entitled DOME FORMING SYSTEM , filed 27 Feb. 2002 by said Assignee and published 6 Sep. 2002 [WO 02/068278 A2], and in Published International Application No. PCT/US01/49392 published 27 Jun. 2002 [WO 02/49787 A1], and in Published International Application No. PCT/US2004/028123 entitled CONTAINER END FORMING SYSTEM, filed 30 Aug. 2004 by said Assignee, published 10 Mar. 2005 [WO 2005/021388 A2], provides a unique and versatile container for fluids, e.g. liquid or fluent materials, wherein various standard can bodies are provided with an end including a neck with a pour opening, a thread lug formation on the neck below the pour opening, together with a reclosable cap having a lug formation which can interlock with the thread lug formation on the neck and including a seal surrounding the pour opening, and capable of maintaining product under pressure or vacuum. The subject matter of those three Published International Applications is hereby incorporated by reference, under the provisions of 37 C.F.R. § 1.57(d)

In particular, the above identified Published International applications disclose systems for producing lugged cap members, of the type to which the present invention pertains, in a single apparatus, e.g. a press or presses fitted with appropriate tooling, which is capable of precise high speed operation to achieve acceptable commercial production of the cap.

SUMMARY OF THE INVENTION

When it is desired to utilize the features provided by this invention, a coin ring is used to coin the metal of the cap central portion in a band of relatively narrow width and of significantly less diameter than the cap itself. This creates slack metal from down in the near-center area of the panel, and results in an 'oil can' configuration, which responds to the increased internal pressure upon filling and closing by causing the central area to "click" or snap to an extended (outward) position. When the container is opened, internal pressure is released and the central area returns to its state before filling. In the meantime, if internal pressure is lowered sufficiently (e.g. below a predetermined value) or released, the central area of the cap will snap (with an audible click) to indicate the internal pressure has been compromised or lost. The invention thus provides a unique indicator for signaling loss of pressure in a filled and un-opened pressurized container, and also provides an indicator that the container cap has been opened and some of the contents may be removed, or (in the case of beverage contents) at least partially consumed.

DESCRIPTION OF PREFERRED EMBODIMENT

Figure 1:
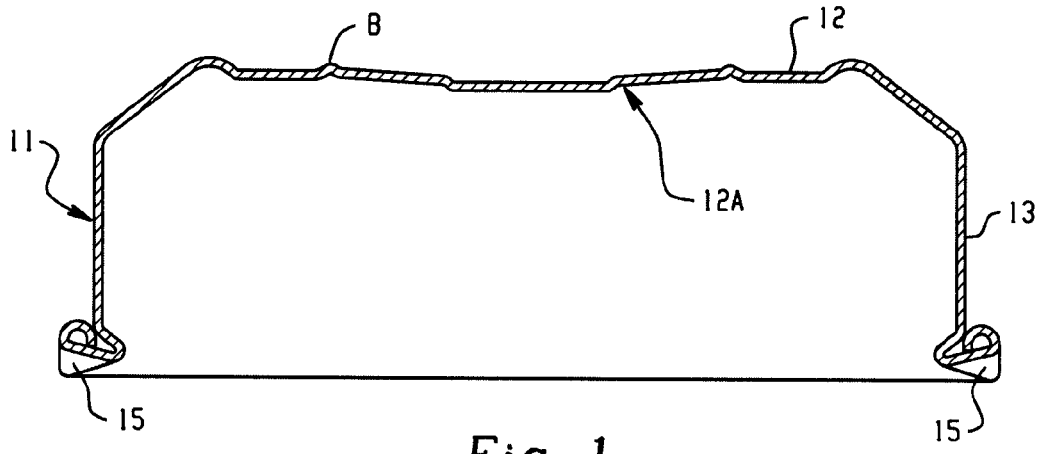
FIG. 1 is a transverse cross-sectional view of a cap provided by the invention.
Figure 2:
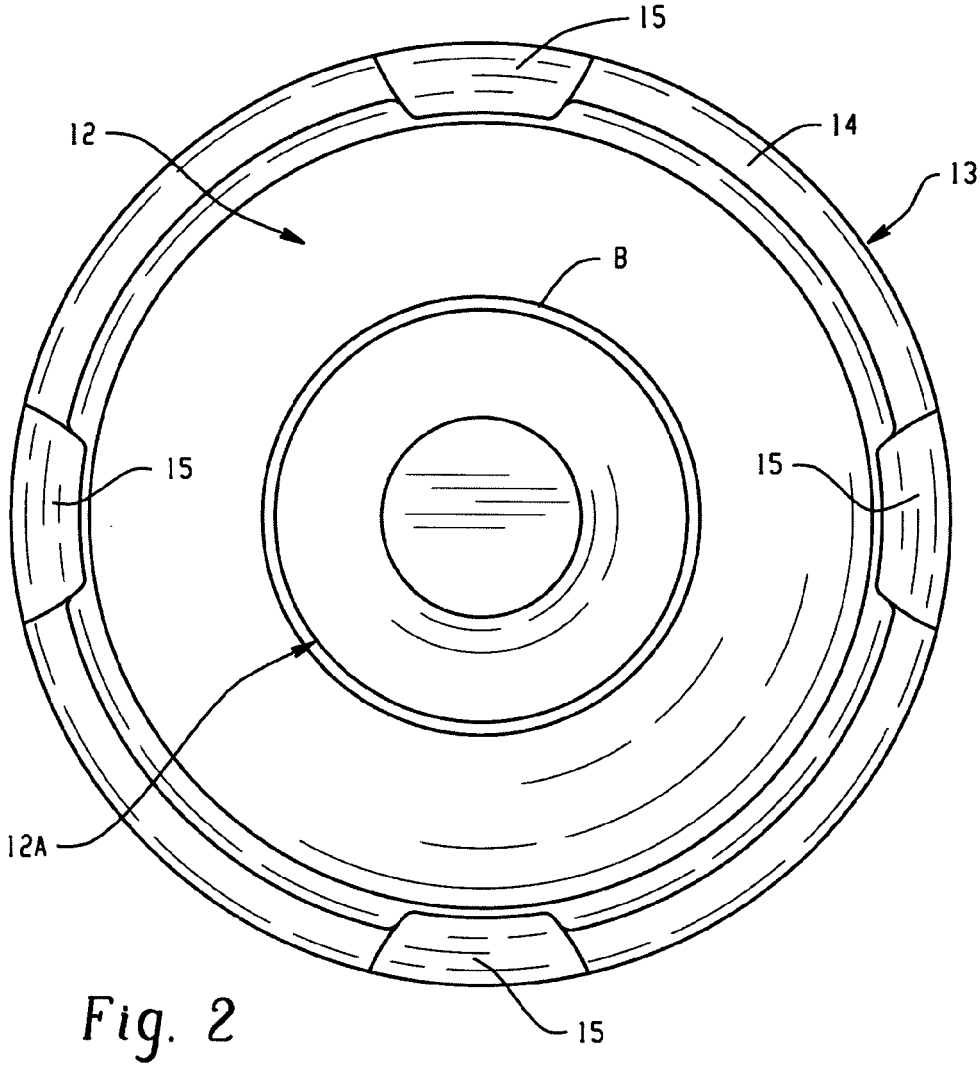
FIG. 2 is a bottom view of the cap shown in FIG. 1.

Details of the two station progressive tooling in a cap making press and associated transfer apparatus are disclosed in the published International application PCT/US01/49392 identified above. The present invention relates to different and unique tooling for the first station(s) of such an apparatus, and the uniqueness of the cap so produced. FIGS. 1 and 2 show such a cap 11 which includes a top panel 12 with a depressed center section 12A, a peripheral side wall 13, and a curled rim 14, together with a plurality of cap lugs 15 which are formed in a second station (not shown herein).

Figure 3:
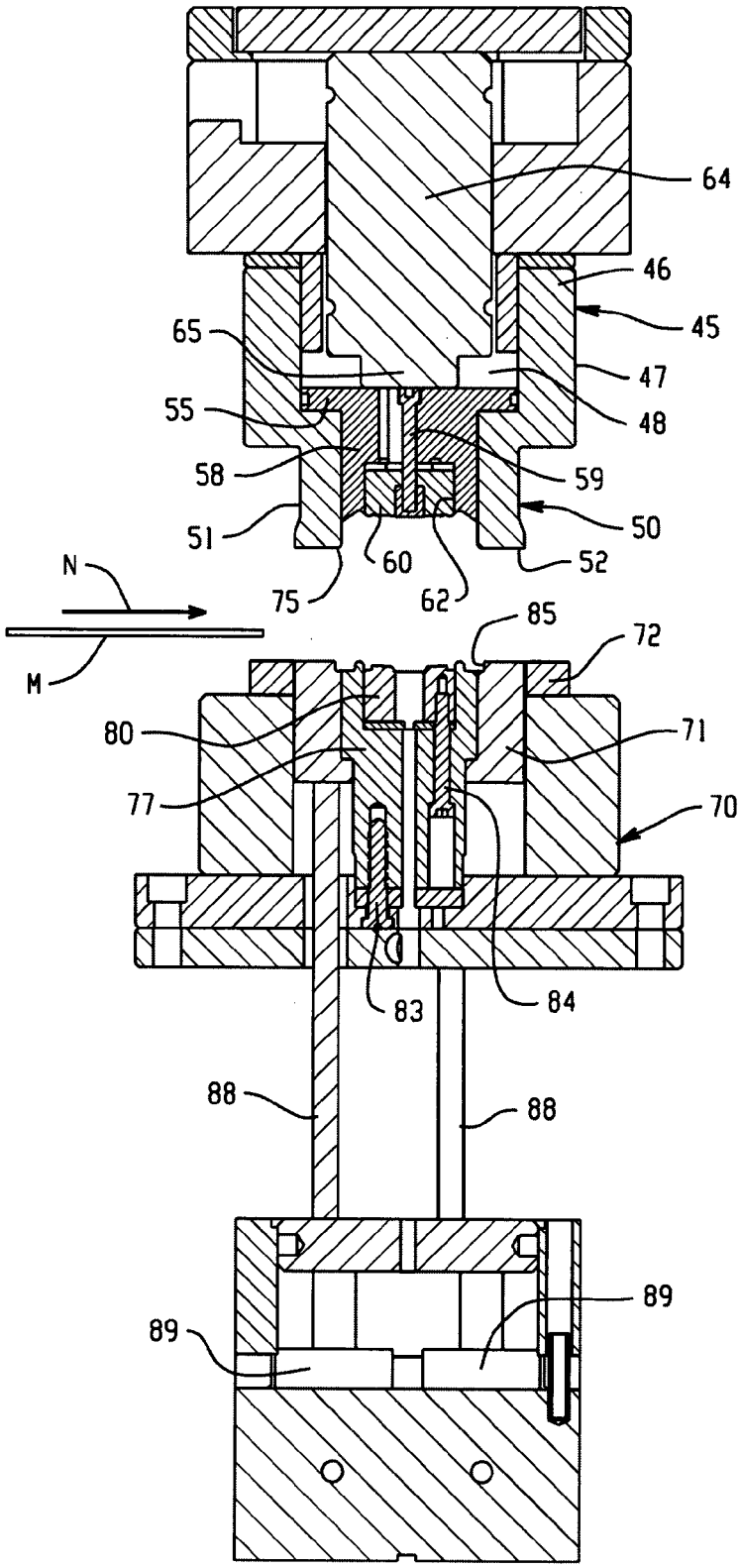
FIG. 3 is a cross-section view of the first station tools in open position.

A coil or sheets of metal material M, typically Aluminum or thin cold rolled steel, which may have on its upper surface appropriate patterns of lithographed materials for the exterior of each cap 11, are fed centrally into the first station(s) by appropriate feeding mechanism of known construction. Sheet feed mechanism which moves the material in step-wise fashion, synchronized to the press strokes, along the feed path indicated by arrow N in FIG. 3. Feeding metal M from a coil into the first stations is a satisfactory operation. However, using sheets facilitates the application of appropriate (and different) exterior appearance on the caps.

Figure 4:
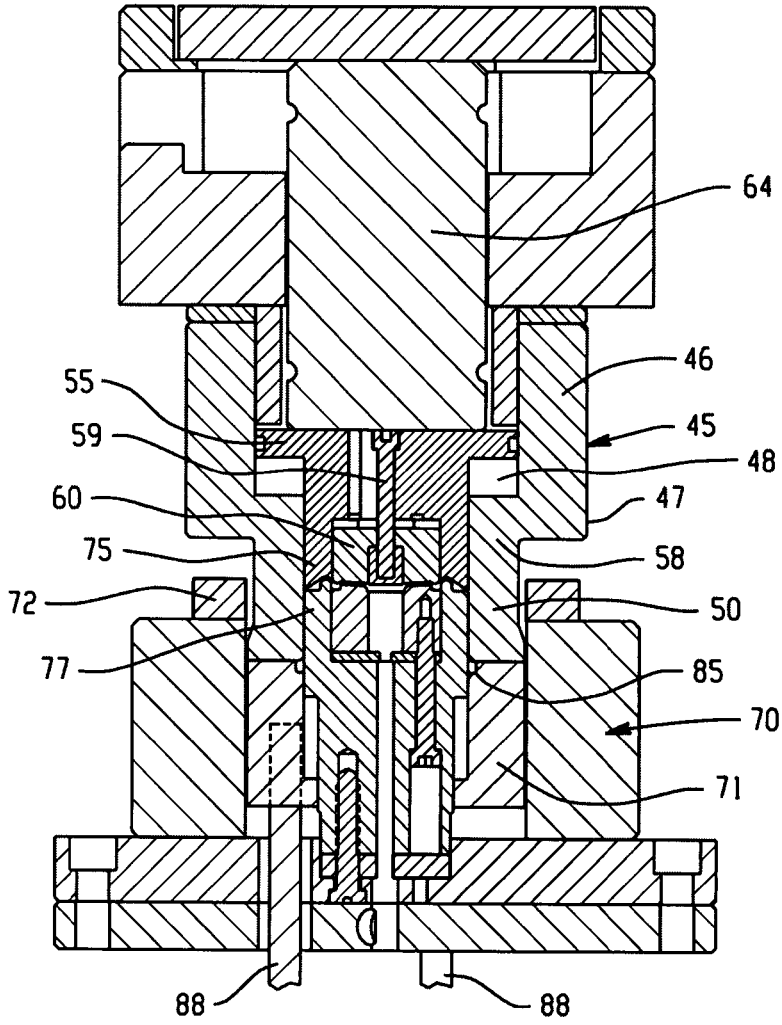
FIG. 4 is a cross-section view of the first station tools in closed position.

The first station tools comprise an upper or blank punch tool 45 (FIG. 3 & 4) having a larger upper portion 46 with an exterior diameter 47, and a recess 48 adjacent its top. The lower portion 50 of blank punch 45 has a smaller diameter 51 which terminates, at its bottom, as the forming or blanking edge 52 of blank punch 45. The cylindrical recess 48 in the top of blank punch 45 contains the piston head 55 of a knock-out member 58 which can reciprocate vertically within the blank punch (compare Figs 3 & 4). The lower edge of knock-out member 58 is shaped to form the outer edge of the cap, as further described.

An upper cavity within piston head 55 receives the head of threaded suspension rod 59 which descends into the lower cavity 62 within blank punch 45. An upper coining tool 60 is fitted to rod 59, and may be adjusted vertically, to locate the coining ring 61 (FIG. 5) and the form insert (which is intended to press against but not deform the center of panel 12A) precisely with respect to the bottom dead center (BDC) location of the upper tooling. A gas spring (or other constant pressure device) 64 is supported above the blank punch tool 45, and its piston 65 descends partially into recess 54 pressing against piston head 55 to provide a predetermined resistance force against knock-out member 58.

The lower tooling of the first station(s) comprises compound lower tooling including a cylindrical base or die ring 70 with an inner diameter that receives a lower draw pad 71. During the initial operation of the first station tools, with the lithographed patterns (if present) aligned with respect to the first station tools, a blank is cut from the material (typically aluminum or thin cold rolled steel) on the down stroke of the press by blank punch 45 passing through cut edge ring 72 on top of lower die ring 70. On the continuation of the down stroke, the lower or forming edge 75 of blank punch 45 moves the cap material about the upper configured edge of draw punch 77, with the material of the disc being carried downward between the exterior side of draw punch 77 and the interior of blank punch 45. These tools cooperate such that the blank is drawn into a cup shaped cap part (see upper portion of cup in FIG. 1), with the edge of the part extending slightly below the lower edge of the draw punch 77 (see FIG. 4 &5), when the press tooling reaches its bottom dead center BDC location.

At that location (the bottom of the press stroke) the upper coining tool 60 has descended to adjacent the lower coining tool 80 which is fitted into a cavity 82 within the top of a draw punch 77. The adjustable screws 83 and 84 provide for precise positioning of the draw punch and lower coining tool 80. When these coining tools 60 & 80 engage the central panel of the cup part between them, they form the depressed panel shape 12A into the cap top panel 12, including the surrounding centered coined band B (FIGS. 1 & 2). The central portion of the panel 12A is depressed as shown in FIG. 1.

Figure 5:
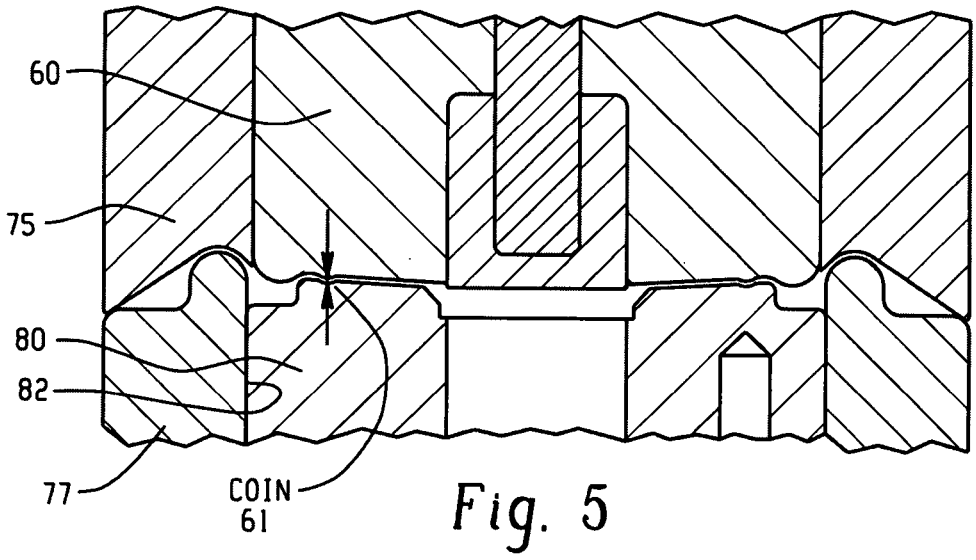
FIG. 5 is an enlarged segmental cross-section view illustrating the first station upper and lower tools in an almost closed position, showing the precisely defined gap wherein the cap top panel is formed.

FIG. 5 illustrates the coining tools 60 and 80 slightly apart, and the space between them represents the cross-section of the cap's upper panel and coined ring, where these tools are more closely spaced and the form insert within the upper coining tool 60 is touching the center of the cap panel 12A. coin ring is used to coin the metal of the cap central portion in a band of relatively narrow width and of significantly lesser diameter than the cap itself. This creates slack metal from down in the near-center area of the panel, and results in an 'oil can' configuration, which responds to the increased internal pressure upon filling and closing by causing the central area to "click" or snap to an extended (outward) position. When the container is opened, internal pressure is released and the central area returns to its state before filling. In the meantime, if internal pressure is lowered sufficiently (e.g. below a predetermined value) or released, the central area of the cap will snap inward (with an audible click) to indicate the internal pressure has been compromised or lost. The coining ring 61 squeezes and deforms the metal in the cap along the coined band B to a cross-sectional thickness less than adjacent portions of the top panel, i.e., less than the remainder of the cap top panel 12 (FIG. 5). Thus, the coined band B segregates the central portion 12A of the panel from the remainder of the cap top panel 12.

On the press up stroke draw pad 71, at the inner upper edge of which the lower curl ring 85 is formed, raises under spring pressure with the blank punch 45. That pressure is provided by rods 88 which extend upward through the lower tooling support plates and against the lower portion of draw pad 71. Fluid pressure from a suitable source (not shown) acts against pistons 89 at the lower ends of rods 88 to provide the effect of a lower 'gas spring'. The bottom edge of the cap wall is curled outward into the cavity of curl ring 85 at the upper inner edge of draw pad 71, completing a formed cap 11 with an outward curled rim 15.

The formed cap in the first station, which is in the nature in an inverted cup, is biased against the upper forming die by a first air stream introduced through passage 50 into the cap as the first station tooling opens, and causes the cap to follow upward against the bottom of the punch 45. As explained in published International Application (Ser. No. PTC/US01/49392, of), during the upward travel of the cap, a second air stream is initiated in a direction across the upper fist station tooling toward a transfer chute (not shown) and is at its full power when punch 45 (with a cap 11 held thereto by the upward directed first air stream) traverses the space through which the second air stream is directed. By the time the first station tooling reaches full open at top dead center TDC of a press stroke, the cap has actually been transferred into a second station for formation of the cap lugs.

Press Rotation Related to Tooling Function

1st Station

0° Top of the Stroke; Top Dead Center
140° Material is Blanked; example, 0.0108 inch thick aluminum
180° Form & draw complete; BDC; Cap Overall Height ~0.585 inch
190° Cap Curl complete; Overall Height is ~0.585 inch; ID is ~1.630 in.; coined band is ~0.750 inch in diameter & ~0.002-0.003 inch thick & 0.012-0.015 inch wide
190° 1st Air turned on; Blows cap against punch tool
220° Blank punch exits Die tool, cap against its face
230° 2nd Transfer Air on; Blows cap into transfer chute to a second station Cap Indicator The cap provided by this invention may be used with a container initially filled with (for example) a liquid into which a small charge of liquid Nitrogen is introduced at the end of a filling, just before such cap as herein described is applied to the container. That charge will change into gaseous state and the container and its contents will be internally pressurized. This action causes the cap to snap or 'click' outward, and to remain in that state until the container is first opened. Then, the internal pressure is relieved and the cap will snap in a reverse manner. The visible change in shape of the cap's top panel will signal that the container has been opened (or perhaps has leaked), and additionally the audible 'click' sound will provide a further signal.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. A lugged metal cap for a container designed to package and hold products stored therein under pressure, said cap comprising a top panel, a generally cylindrical side wall integral with and depending from a periphery of said top panel, an outwardly curled rim extending around a lower edge of said side wall, and a plurality of cap lugs formed on said rim extending inward thereof; the improvement comprising a central coined band formed in said top panel radially inward of the periphery of said top panel and having a cross-sectional thickness less than the adjacent portions of said top panel, a central area of said top panel surrounded by said coined band being normally depressed with respect to a remaining area of said top panel, said coined band and said central area surrounded by said coined band being pre-stressed so as to snap normally downward of the top panel, whereby when the cap is attached and sealed to a filled and internally pressurized container, the central area of the top panel will snap upwardly in response to internal pressure, and at a later time will snap downwardly so as to signal a loss of internal pressure within the container.

2. In a system for forming container caps, the improvement comprising first station tools comprising a blank punch tool and a cooperating die tool adapted for mounting in a press for cyclic movement between an open position in which said tools are separated and a closed position in which said tools are closely spaced to form a cap from a metal blank during the closing motion of said tools and then to draw the blank into a cup-shaped part with a top panel and a side wall extending from said top panel, said punch tool including a coining configuration constructed and arranged to contact a ring portion of the top panel of the metal blank, outward of a center of said top panel, and to cooperate with said die tool when moved into contact with an underside of said top panel and inward of a junction of the top panel and the side wall to create a pre-stressed coined ring in said top panel and to displace metal inwardly of said coined ring, whereby said top panel will snap upwardly when said cap is sealed onto the top of a filled and pressurized container, and will snap downwardly upon loss of pressurization.

3. The cap of claim 1 wherein the central coined band is circumferentially continuous.

4. The cap of claim 1 wherein the coined band has a relatively narrow width in comparison to the remainder of the cap.

5. The cap of claim 1 wherein the coined band has a significantly lesser diameter than a diameter of the cap.

6. The cap of claim 1 wherein the coined band has a substantially annular configuration.

* * * * *